US005113478A

United States Patent [19]

Nakashima et al.

[11] Patent Number: 5,113,478

[45] Date of Patent: May 12, 1992

[54] LIQUID FUEL VAPORIZING APPARATUS

[75] Inventors: Kenro Nakashima, Yokohama; Kazuhiro Hatanaka, Tokyo; Hideo Ohta, Ebina, all of Japan

[73] Assignee: Isuzu Motors Limited, Tokyo, Japan

[21] Appl. No.: 564,509

[22] Filed: Aug. 8, 1990

[30] Foreign Application Priority Data

Aug. 29, 1989 [JP] Japan ..... 1-220257

[51] Int. Cl.[5] ..... H05B 1/00

[52] U.S. Cl. ..... 392/395; 431/208; 431/261; 431/262; 392/398; 392/489

[58] Field of Search ..... 431/207, 208, 243, 240, 431/241, 242, 28, 36, 41, 258, 259, 261, 260, 262; 60/736; 392/391, 395, 397, 398, 488, 489, 485; 123/549

[56] References Cited

U.S. PATENT DOCUMENTS

| | | | |
|---|---|---|---|
| 2,286,857 | 6/1942 | Holthouse, Jr. | 431/208 X |
| 2,712,352 | 7/1955 | Manor et al. | 431/259 |
| 2,974,723 | 3/1961 | Blanchard . | |
| 3,086,579 | 4/1963 | Brown | 431/262 |
| 3,531,229 | 9/1970 | Berglund | 431/262 |
| 4,207,055 | 6/1980 | Tamaka | 431/258 |
| 4,459,805 | 7/1984 | Kamiya et al. . | |
| 4,703,888 | 11/1987 | Kawamura et al. | 237/123 C X |
| 4,778,376 | 10/1988 | Pollock et al. | 431/258 X |
| 4,784,331 | 12/1988 | Kawamura | 431/262 |
| 4,931,011 | 6/1990 | Reiser et al. | 431/28 X |

FOREIGN PATENT DOCUMENTS

| | | | |
|---|---|---|---|
| 0003505 | 1/1980 | Japan | 431/208 |
| 62-62108 | 3/1987 | Japan . | |
| 0065213 | 3/1988 | Japan | 431/11 |
| 63-65213 | 3/1988 | Japan . | |

*Primary Examiner*—Carl D. Price

*Attorney, Agent, or Firm*—Browdy and Neimark

[57] ABSTRACT

This liquid fuel vaporizing apparatus is so designed that liquid fuel is vaporized by a heating plug disposed in a tubular body when the temperature in a combustion chamber is low while it is vaporized by a radiant heat of the combustion chamber received by heat-receiving fins provided in the outer-peripheral part of the tubular body when the temperature in the combustion chamber is high. Particularly, an open-cellular member having intercommunication porosity which has numerous intercommunicating pores being excellent in heat conducting properties is disposed in a fuel passage in the tubular body, and the heat transfer area of said member is increased to make uniform the state of reception of heat from the heat-receiving fins. The liquid fuel is turned into a thin films by intercommunicating pores in the tubular body to improve a vaporizable property and thereby to prevent the bumping of oil droplets in the tubular body, thus making the vaporized fuel jetted excellently at all times from a fuel injection pipe.

5 Claims, 1 Drawing Sheet

LIQUID FUEL VAPORIZING APPARATUS

BACKGROUND OF THE INVENTION

1. Field of the Invention

This invention relates to a liquid fuel vaporizing apparatus for producing vaporized fuel by vaporizing liquid fuel used for a combustion unit.

2. Description of the Prior Art

A liquid fuel vaporizing apparatus shown in FIG. 2 has been disclosed heretofore as the one incorporated in the combustion unit. In FIG. 2, a liquid fuel vaporizing apparatus 20 has a construction wherein a heating plug 10, which is a glow plug for vaporization or the like, is incorporated in a hollow vaporizing pipe made of metal, that is, a tubular body 2. On the outer peripheral surface of the tubular body 2, a number of heat-receiving fins 5 are formed. These heat-receiving fins 5 are formed in the circumferential direction of the tubular body 2. The tubular body 2 is fitted with a vaporized fuel injection pipe 6 in one end part thereof and with a liquid fuel feed pipe 9 in the other end part thereof. In the tubular body 2, the heating plug 10, which is a solid heater core, i.e. the glow plug, is so inserted as to form a fuel passage 8. The heating plug 10 is formed of a member of ceramic or silicon nitride or the like, and it has a heating part wherein a resistance wire (omitted in the figure) made up of tungsten is buried or printed in adhesion. In the downstream part of the fuel passage 8, a fuel outlet part 15 is formed. A liquid fuel introduction port 14 of the liquid fuel feed pipe 9 communicates with the fuel passage 8. In the base end part of the heating plug 10, a terminal 11 is provided. An injection port 7 of the vaporized fuel injection pipe 6 is so provided as to open in a combustion chamber of an ordinary combustion unit. In the FIG. (2), the arrows show the direction of flow of the fuel.

A liquid fuel vaporizing apparatus disclosed in Japanese Patent Laid-Open No. 65213/1988 can be cited as a usual one. Said liquid fuel vaporizing apparatus is characterized in that an inner tube having heat-releasing fins provided on the inner peripheral surface is pressed in and fitted to a tubular body having heat-receiving fins provided on the outer peripheral surface, a heating plug being so inserted into said inner tube as to form a fuel passage, a vaporized fuel injection pipe is fitted to one end of the tubular body, and a fuel introduction pipe is fitted to the other end of the tubular body. In this liquid fuel vaporizing apparatus the heat-releasing fins formed on the inner peripheral surface of said inner tube extend in the longitudinal direction of the inner tube, while the inner tube is constructed of a sleeve made of metal and is disposed in a combustion chamber of a combustion unit. The heating plug functions as a glow plug for vaporization in the combustion unit.

A combustion unit disclosed in Japanese Patent Laid-Open No. 62108/1987, and is provided with a combustion tube and a fuel vaporizing apparatus having a nozzle for injecting vaporized fuel, which opens inside of the combustion tube, and a mesh-shaped body surrounding a heating part of the glow plug for vaporization of the fuel vaporizing apparatus is disposed in a cylindrical part into which the heating part is inserted.

It cannot be said that the liquid fuel vaporizing apparatus used in said combustion unit vaporizes liquid fuel sufficiently, although it can be vaporized rapidly to some degree. The liquid fuel cannot be vaporized satisfactorily as liquid fuel of low grade by the radiant heat of the combustion chamber. The liquid fuel vaporizing apparatus is so designed that the heating plug is normally turned off on the occasion of regular combustion of the combustion unit and the heat energy in the combustion chamber is conducted to the fuel passage in the tubular body from heat-receiving fins formed on the outer peripheral surface of the tubular body so as to vaporize the liquid fuel to produce vaporized fuel, which is jetted into the combustion chamber from the fuel injection pipe.

In the liquid fuel vaporizing apparatus, heat conduction in the tubular body is effected in a mode a boiling heat conduction of two-phase flow of vapor and liquid phases, and when reception of the heat from the inside of the combustion chamber of the combustion unit is not uniform, abrupt boiling on the wall surface, i.e. bumping occurs wherein boiling occurs abruptly only at a higher temperature than the boiling point when a liquid is heated in a local part inside of the tube. Consequently, the fuel takes the liquid phase in the central part of a singlehole passage of the fuel injection pipe, while taking the state of the vapor phase in the peripheral part of the wall surface of the single-hole passage. When the heating plug disposed in the tubular body of the liquid fuel vaporizing apparatus is turned off, a liquid film of the liquid fuel is formed on the surface of said heating plug and the liquid film cannot be vaporized. Besides, the liquid fuel flows through the easiest-to-pass part of the passage and is jetted from the fuel injection without being vaporized, and in some cases, oil droplets are jetted in a bumping state from the fuel injection pipe. Consequently, heat conduction of the heat energy to the flowing liquid fuel is insufficient and the vaporizable property of the liquid fuel is deteriorated, and is undesirable for combustion and causes deposition of carbon inside the tubular body.

SUMMARY OF THE INVENTION

The main object of this invention is to solve the above-stated problems and to furnish a liquid fuel vaporizing apparatus for vaporizing fuel rapidly and jetting the vaporized fuel into a combustion chamber. More concretely, a liquid fuel vaporizing apparatus is furnished wherein liquid fuel is vaporized rapidly and reliably to produce vaporized fuel by using a heating plug incorporated in the initial stage of combustion of a combustion unit, wherein the combustion in the combustion unit is in a furious state so that, the liquid fuel is vaporized rapidly, reliably and uniformly to produce vaporized fuel by the heat energy in the combustion chamber received by heat-receiving fins provided on the outer peripheral surface and conducted through an open-cellular member having intercommunicating porosity which is made up of a material having numerous intercommunicating pores, is excellent in heat conducting properties and is disposed in the tubular body. Additionally, the vaporized fuel is passed through a porous passage formed of the aforesaid open-cellular member provided in a fuel outlet part in the tubular body wherein the heat is easiest to receive, so as of further improve the uniformity to vaporization and prevent bumping of liquid droplets in the tubular body.

Another object of this invention is to furnish a liquid fuel vaporizing apparatus which is constructed of a tubular body provided with heat-receiving fins on the outer peripheral surface, a fuel injection pipe opening in the combustion chamber, a heating plug disposed in the tubular body, a fuel passage formed between said heating plug and said tubular body, and an open-cellular member having intercommunicating porosity disposed on the inner peripheral surface of said tubular body and in the fuel outlet part of said tubular body on said fuel injection pipe side, and made of a material having numerous intercommunicating pores and being excellent in heat conducting properties.

Another object of this invention is to furnish a liquid fuel vaporizing apparatus wherein, by disposing the open-cellular member having intercommunicating porosity made up of a material having numerous intercommunicating pores and being excellent in heat conducting properties, on the inner peripheral surface of the tubular body and in the fuel outlet part of said tubular body on the fuel injection pipe side, so that the liquid fuel is made to flow through numerous porous passages of the open-cellular member provided in contact with the fuel outlet part and the inner peripheral surface of the tubular body, where the heat is easiest to receive. The area of contact of the liquid fuel with the open-cellular member provided in contact with the inner peripheral surface of the tubular body is increased and consequently a heat-receiving area for receiving the heat energy is increased, so that the liquid fuel is vaporized uniformly, rapidly and reliably. In particular, the fuel is made to pass forcedly through the open-cellular member in the fuel outlet part of said tubular body when it is jetted into the fuel injection pipe from the tubular body. Even when any liquid droplet is present, therefore, it is separated by the numerous intercommunicating pores, thereby preventing liquid droplet from being jetted in the bumping state from the fuel injection pipe. The deposition of carbon in said fuel outlet part is also held back, and the combustion is made stable with facilitated vaporization of the fuel, and thus the performance of the combustion unit is improved.

Still another object of the invention is to furnish a liquid fuel vaporizing apparatus wherein, even when the liquid film of the liquid fuel formed on the surface of the heating plug disposed in the tubular body is turned off and the fuel is not vaporized, the fuel is put in a state of being given the sufficient heat of vaporization, to pass it through the numerous intercommunicating pores of the open-cellular member having intercommunicating porosity, thereby facilitating vaporization of the liquid fuel and thus sufficiently vaporizing the fuel being jetted from the fuel injection pipe. In this apparatus, the liquid fuel, particularly the liquid fuel that is reluctant to be vaporized (i.e. the liquid fuel of low grade), is vaporized efficiently and uniformly, and the vaporized fuel is jetted smoothly into the combustion chamber from the fuel injection pipe.

Yet another object of the invention is to furnish the liquid fuel vaporizing apparatus which makes it possible to vaporize a liquid fuel rapidly, reliably and uniformly. In particular, to make the fuel thus vaporized burn completely, to hold back the occurrence of such phenomenon as deposition of carbon due to imperfect vaporization and thus to make the vaporized fuel burn immediately. Therefore, the fuel can be supplied rapidly for heating purposes at all times, the liquid fuel is in an optimum quantity and can be fed to a fuel feed passage through a fuel feed pipe so as to produce in order, the vaporized fuel necessary for combustion. Moreover, the feeding quantity of the liquid fuel and the making and breaking of the heating plug can be controlled so as to vaporize the liquid fuel by the heating plug in the initial stage of combustion. Thus, the apparatus is very desirable in terms of safety.

DETAILED DESCRIPTION OF THE INVENTION

Figure 1:
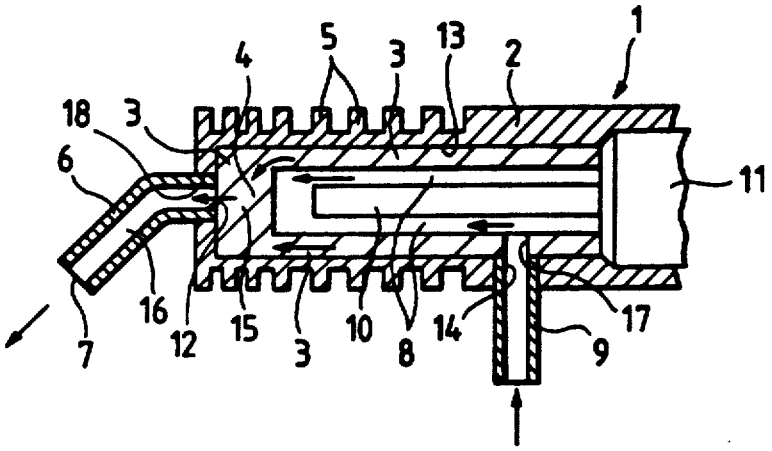
FIG. 1 is a sectional view of one embodiment of a liquid fuel vaporizing apparatus according to invention.

One embodiment of the liquid fuel vaporizing apparatus according to this invention is described hereunder with reference to FIG. 1.

Figure 2:
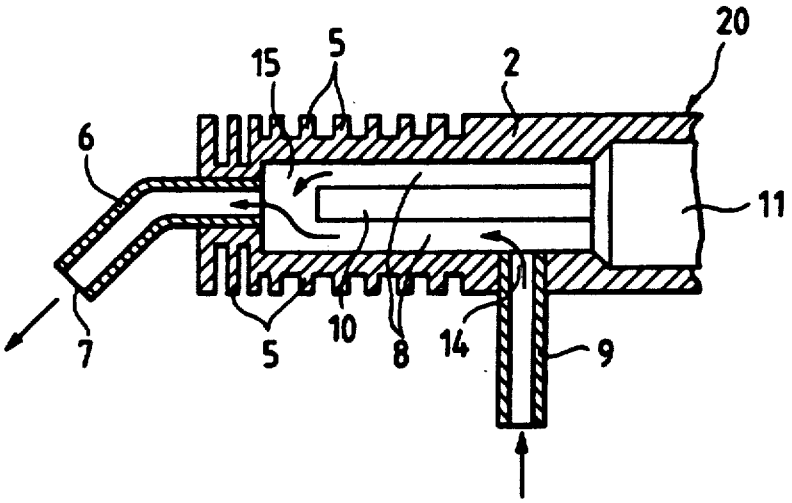
FIG. 2 (PRIOR ART)
FIG. 2 is a sectional view of one example of a conventional liquid fuel vaporizing apparatus.

In FIG. 1, the liquid fuel vaporizing apparatus is shown as a whole is denoted by numeral 1. The liquid fuel vaporizing apparatus 1 is disposed in a combustion unit (not shown in the figure). Compared with the liquid fuel vaporizing apparatus described with reference to FIG. 2, the liquid fuel vaporizing apparatus 1 of this invention has the same construction as the above apparatus except that an open-cellular member 3 having an intercommunicating porosity, and which is made up of a porous material having numerous intercommunicating pores, and is excellent in heat conducting properties is provided in the fuel outlet part of a tubular body 2. The open-cellular member is positioned in the part of fitting of a fuel injection pipe 6 fitted to the fore end of the tubular body 2, and on the inner peripheral surface of tubular body 2. Therefore, the same markings are given to the same components with those of the liquid fuel vaporizing apparatus shown in FIG. 2 and descriptions that overlap are omitted.

In the liquid fuel vaporizing apparatus according to the invention, the open-cellular member 3 having intercommunicating porosity is disposed in a fuel passage 8 formed inside the hollow tubular body 2, and said open-cellular member 3 is disposed in a state of contact with a fuel outlet part 15 of the tubular body 2, on fuel injection pipe 6 side and within the inner peripheral surface 13 of the tubular body 2. In the outer peripheral part of this tubular body 2, heat-receiving fins 5 receiving heat to vaporize the liquid fuel from the outside, i.e. a secondary combustion chamber, are provided, and a fuel outlet 12 is formed in one end part thereof, while a fuel feed port 14 is formed on the other end part. The fuel injection pipe 6 is joined, in one end part 18, to the fuel outlet 12, formed in the tubular body 2, and is provided with an injection port 7 from which the fuel in the tubular body 2 is jetted outside.

This open-cellular member 3 having intercommunicating porosity has numerous intercommunicating pores which provide numerous passages that produce no adverse effect on the state of flow of the liquid fuel, and is made up of a material, such as an aluminum powder sintered alloy excellent in heat conducting properties. The open-cellular member 3 is formed of a blind-like end part 4 disposed in contact with a fuel outlet part 15, which is the part of the fitting of fuel injection pipe 6 with the tubular body 2, and is a hollow tubular part disposed in contact with the inner peripheral surface of the tubular body 2. In addition, a fuel feed port 17 communicating with fuel feed port 14 formed in the tubular body 2 is formed in the open-cellular member 3, and said fuel feed port 17 opens in the fuel passage 8. A heating plug 10 is inserted into the tubular body 2 from the end part thereof on the opposite side to the end part wherein the fuel outlet 12 of the tubular body 2 is formed. A heating part of the heating plug 10 is disposed in an extension in the longitudinal direction inside the hollow tubular part of the open-cellular member 3. The fuel passage 8 formed between the tubular body 2 and the heating plug 10 ends in front of the fore end of the heating plug 10 that is inserted into the tubular body 2 and communicates with a single-hole fuel passage 16 of the fuel injection pipe 6, through the end part 4 of the open-cellular member 3. To the fuel feed port 14 of the tubular body 2, a fuel feed pipe 9 is joined for feeding the liquid fuel to the fuel passage 8. Accordingly, the fuel fed through the fuel feed pipe 9 is supplied directly to the fuel passage 8 through the fuel feed port 14 of the tubular body 2 and the fuel feed port 17 of the open-cellular member 3.

In this liquid fuel vaporizing apparatus 1, the inner peripheral surface of the tubular body 2, wherein the end part 4 of the open-cellular member 3 is disposed is positioned normally in a part wherein the heat easiest to receive from the outside, i.e. the combustion chamber of the combustion unit. The fuel flowing through the open-cellular member 3 is always put in a state of passing forcibly through innumerable porous passages formed of numerous intercommunicating pores of the open-cellular member 3. Accordingly, the heat energy received from the heat-receiving fins 5 of the tubular body 2 is given sufficiently to the open-cellular member 3 and then given also sufficiently to the liquid fuel passing through the open-cellular member 3. Consequently, the heat reaches the central part of the fuel in full, thereby further facilitating vaporization of the liquid fuel and preventing the fuel from jetting in a bumping state onto the outside, i.e. into the combustion chamber from the fuel injection pipe 6.

The liquid fuel vaporizing apparatus according to the invention as described above operates as follows:

In order to make the operation of the liquid fuel vaporizing apparatus 1 more comprehensible, a description will be made of one example of the application of a liquid fuel vaporizing apparatus 1 to the combustion unit.

In this liquid fuel vaporizing apparatus, first, the heating part, i.e. a resistance wire, of the heating plug 10, being a glow plug for vaporization, in the tubular body 2 is electrified from a terminal 11, so as to be heated, while the liquid fuel sent in from a fuel feed pump is supplied into the fuel passage 8 from the liquid fuel feed pipe 9 through liquid fuel feed port 14 and fuel feed port or passage 17 and brought into contact with the heating part of the heating plug 10, so as to be vaporized. Subsequently, the vaporized fuel passes from the fuel passage 8 through the intercommunicating pores in the end part 4 of the open-cellular member 3 having intercommunicating porosity, and passes from the fuel outlet part 15 through the fuel injection pipe 6 and is jetted from the injection port 7 into a primary combustion chamber, wherein a glow plug for igniting the combustion unit is provided. Although a few oil droplets are jetted in the vaporized fuel at first, on occasion, the oil droplets have a function of making the ignition of the vaporized fuel very smooth when it is ignited. Meanwhile, combustion air is sent in from an air intake passage of the combustion unit and turns around through a circular space between an outer tube housing and a combustion tube, and is blown into the primary combustion chamber and the secondary combustion chamber from a large number of air introduction orifices formed in the combustion tube made of ceramic. A part of the combustion air blown into the secondary combustion chamber is sent into the primary combustion chamber through a cut passage which is an opening of a partition plate. The vaporized fuel and the air for combustion are mixed to be in a homogeneous state, and the fuel with the fuel-air mixture thus produced, is ignited by the glow plug and burned. Subsequently, the vaporized fuel is ignited and burned, and while mixed with the combustion air, it is blown out into the secondary combustion chamber and burned completely. The burned vaporized fuel turns into a combustion gas, which is sent out from a combustion gas delivery port formed in the combustion unit to a heat exchanger or the like and through a combustion gas delivery pipe.

When the state of combustion in the combustion chamber of the combustion unit becomes furious, the tubular body 2 of the liquid fuel vaporizing apparatus 1, itself turns to receive radiant heat through the intermediary of a large number of heat-receiving fins 5 provided on said tubular body 2. In this state, the electrification of the resistance wire of the heating plug 10, which is a glow plug for vaporization of the liquid fuel vaporizing apparatus 1, is stopped. Thereafter the liquid fuel vaporizing apparatus 1 receives the radiant heat from the secondary combustion chamber of the combustion unit through heat-receiving fins 5, and the radiant heat is conducted thermally to the open-cellular member 3 from the inner peripheral surface of the tubular body 2 and released into the fuel passage 8. Moreover, the radiant heat from said secondary combustion chamber is conducted to the heat-receiving fins 5, and the largest heat energy is released in the part of the blind-like part 4 of the open-cellular member 3, where the liquid fuel is vaporized by this heat energy into the vaporized fuel, and the vaporized fuel produced passes through the intercommunicating pores of the blind-like part 4 of the open-cellular member 3 and is jetted into the primary combustion chamber from the fuel injection pipe 6. When it is desired to vaporize the liquid fuel rapidly, even when the combustion in the combustion unit is furious, or in the case when the liquid fuel used is of the kind that is reluctant to be vaporized, the electrification of the resistance wire of the heating plug 10 of the liquid fuel vaporizing apparatus 1 is not stopped and the operation thereof may be continued. When the state of combustion in the combustion unit is weak, it is also possible to put the resistance wire of an electrified heating plug 10 in the state and thereby accelerate the vaporization of the liquid fuel.

While the embodiment of the liquid fuel vaporizing apparatus according to this invention is described in detail above, the apparatus is not always limited to these details. Although the heat-receiving fins formed on the outer peripheral surface of the tubular body are arranged in the circumferential direction of the tubular body, for instance, they are not necessarily formed in the circumferential direction of the tubular body, but may be formed in the longitudinal direction of the tubular body. Besides, the fuel injection pipe can be formed in various shapes in conformity with the structure of the combustion unit, although it is formed in a bent shape in the embodiment shown. Although the fuel feed pipe is fitted to the tubular body substantially at a right angle thereto, the fitting structure is not always so limited, and may also be fitted in parallel or in a state of being buried in the tubular body, and can be formed in various shapes in conformity with the structure of the combustion unit when the liquid fuel vaporizing apparatus is fitted to the combustion unit.

What is claimed is:

1. A liquid fuel vaporizing apparatus comprising a hollow tubular body having at its periphery a fin for receiving external heat to vaporize liquid fuel, said tubular body having a fuel outlet at one end and a fuel feed port at another end;

a fuel injection pipe of which one end communicates with said fuel outlet of said tubular body and of which another end is provided with an injection port;

a heating plug disposed in the hollow part of said tubular body to vaporize the liquid fuel, said heating plug having a heating part in said hollow part of said tubular body;

a fuel passage formed between an outer surface of said heating plug and an inner surface of said tubular body; and a fuel feed pipe which communicates with said fuel food port to feed the liquid fuel into said fuel passage formed in said tubular body;

said liquid fuel vaporizing apparatus further comprising:

an open-cellular member having intercommunicating porosity and made of a sintered metal is disposed in the fuel outlet of said tubular body, said open-cellular member having numerous intercommunicating pores; said member defining an open-cellular material made of metal and being integrally continuous so as to not prevent thermal conductivity therein, and being spaced from the heating plug, and wherein said open-cellular member having intercommunicating porosity made of sintered metals is formed of a blind end part disposed in contact with said fuel outlet of said tubular body, and a hollow tubular part is disposed in contact with the inner surface of said tubular body, and said heating part of said heating plug is disposed extended in a longitudinal direction in said hollow tubular part.

2. A liquid fuel vaporizing apparatus according to claim 1, wherein said open-cellular member having intercommunicating porosity is made of a sintered aluminum alloy.

3. A liquid fuel vaporizing apparatus comprising a tubular body having at its periphery a fin for receiving external heat to vaporize liquid fuel, said tubular body having a fuel outlet at one end and a fuel feed port at the other end;

a fuel injection pipe of which one end communicates with said fuel outlet of said tubular body and of which another end is provided with an injection port;

a heating plug inserted into said tubular body from an end part opposite to the end part of said tubular body having said fuel outlet formed therein, and disposed in said tubular body to vaporize the liquid fuel, said heating plug having a heating part disposed in said hollow part and a terminal for feeding an electric current to said heating part;

a fuel passage formed between an outer surface of said heating part of said heating plug and an inner surface of said tubular body; and a fuel feed pipe which communicates with said fuel feed port so as to feed the liquid fuel into said fuel passage formed in said tubular body;

wherein the liquid fuel vaporizing apparatus further comprises:

an open-cellular member having intercommunicating porosity and made of sintered metals disposed in the fuel outlet of said tubular body; said open-cellular member being formed of a good conductor of heat having numerous intercommunicating pores and provided with a fuel feed passage communicating with said fuel feed port of said tubular body, and said member defining an open-cellular material being integrally continuous so as to not prevent thermal conductivity therein, and being spaced from the heating plug;

and wherein said open-cellular member having intercommunicating porosity made of sintered metals is formed of a blind end part disposed in contact with said fuel outlet of said tubular body, and a hollow tubular part is disposed in contact with the inner surface of said tubular body, and said heating part of said heating plug is disposed extended in a longitudinal direction in said hollow tubular part.

4. A liquid fuel vaporizing apparatus according to claim 3, wherein the fuel fed through said fuel feed pipe is passed through said fuel feed port of said tubular body and said fuel feed passage of said open-cellular member having intercommunicating porosity and is fed directly into said fuel passage formed between the inner surface of said open-cellular member and the outer surface of said heating part of said heating plug.

5. A liquid vaporizing apparatus according to claim 3, wherein said open-cellular member having intercommunicating porosity is made of a sintered aluminum alloy.

* * * * *